US005596880A

United States Patent [19]

Welker et al.

[11] Patent Number: 5,596,880

[45] **Date of Patent: *Jan. 28, 1997**

[54] CHILLED BEVERAGE DISPLAY CONTAINER

[75] Inventors: Brian H. Welker, Winston-Salem; Mark T. Beeler, Pfafftown; David M. Rogers, Winston-Salem, all of N.C.

[73] Assignee: Decision Point Marketing, Winston-Salem, N.C.

[ * ] Notice: The term of this patent shall not extend beyond the expiration date of Pat. No. 5,433,085.

[21] Appl. No.: 500,435

[22] Filed: Jul. 10, 1995

Related U.S. Application Data

[63] Continuation-in-part of Ser. No. 195,560, Feb. 14, 1994, Pat. No. 5,433,085.

[51] Int. Cl.[6] ..... F25D 3/08; G09F 15/00

[52] U.S. Cl. ..... 62/372; 63/464; 63/457.1; 40/607

[58] Field of Search ..... 62/371, 372, 457.1, 62/457.5, 464, 245, 246, 250, 329; 40/606, 607, 610; 248/519, 539, 511, 523, 346.03

[56] References Cited

U.S. PATENT DOCUMENTS

| | | | |
|---|---|---|---|
| 309,233 | 12/1884 | Luhmann . | |
| 608,701 | 8/1898 | Morse . | |
| 2,453,017 | 11/1942 | Kaufman | 62/133 |
| 4,220,048 | 9/1980 | Grepiotis et al. | 73/323 |
| 4,724,682 | 2/1988 | Flum et al. | 62/462 |
| 4,946,032 | 8/1990 | Stoddard et al. | 206/44 R |
| 4,982,840 | 1/1991 | Bidwell et al. | 206/223 |
| 4,995,238 | 2/1991 | King | 62/125 |
| 5,048,171 | 9/1991 | Bidwell et al. | 29/401.1 |
| 5,048,305 | 9/1991 | Taub | 62/372 |
| 5,196,020 | 12/1992 | Spamer | 220/444 |
| 5,261,253 | 11/1993 | Spenard | 62/250 |

OTHER PUBLICATIONS

P–O–P Times Brochure, 1994.

All Cold Barrels Are Not Created Equal!, Pepsi–Cola Company advertisement, Oct. 3, 1994.

With The New Pepsi Flotation Barrel, Your Profits Will Rise; Pepsi–Cola Company advertisement, Admitted Prior Art.

*Primary Examiner*—William Doerrler

*Attorney, Agent, or Firm*—Rhodes Coats & Bennett, L.L.P.

[57] ABSTRACT

A beverage container adapted to hold ice and beverages separate from water formed from melted ice includes a receptacle having an interior cavity for holding ice and beverages; a float having a density less than water adapted to support the ice and beverages and move upwardly within the cavity as the ice melts; a cover mounted on the receptacle by a hinge having three slots including a recess and an opening at a depth in the recess, and a tubesign base having three tabs having distal ends, lobes on the distal ends and lengths from bases of the tabs to their lobes corresponding to the depth, so as to enable removable attachment of the tubesign base to the hinge by insertion of the tabs in the slots, with the lobes locking the tabs into the slots when inserted therein.

22 Claims, 6 Drawing Sheets

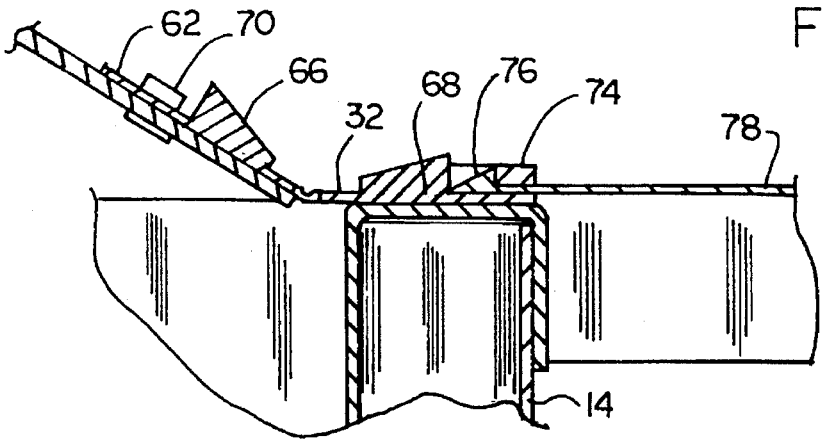
FIG. 7
FIG. 8
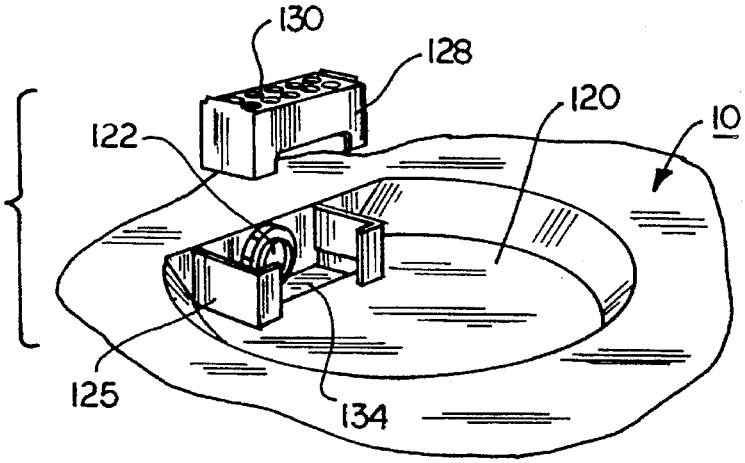
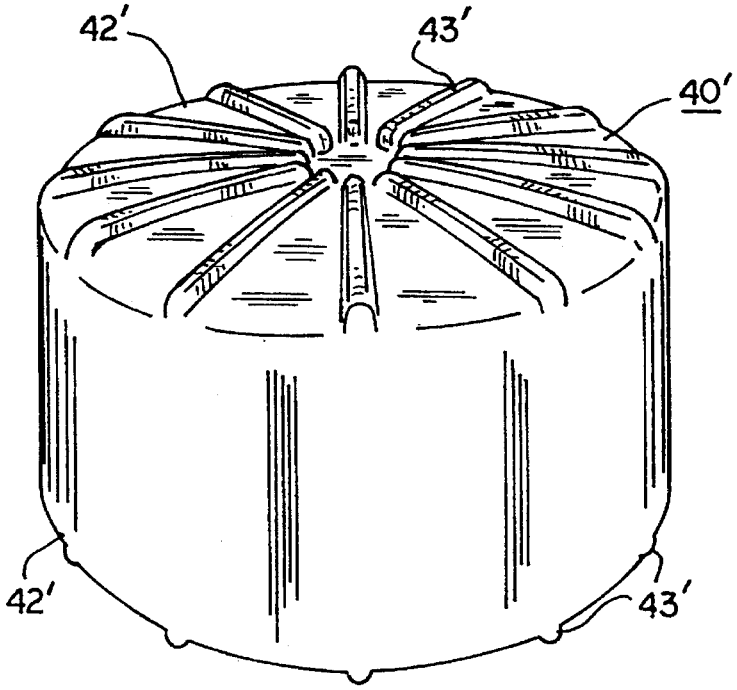
FIG. 9

CHILLED BEVERAGE DISPLAY CONTAINER

BACKGROUND OF THE INVENTION

This application is a continuation-in-part of application Ser. No. 08/195,560 filed Feb. 14, 1994, now U.S. Pat. No. 5,433,085. The present invention relates to an improved chilled beverage display container for holding beverages and ice so that the beverages and unmelted ice are supported near the top of the container and separate from melted ice, or water.

Beverages, e.g., soft drinks or beer in cans or bottles, are often displayed at retail outlets in chilled containers, which are frequently located close to check-out counters to stimulate impulse purchases by departing customers. Normally, these containers are comprised of an open top receptacle having a bottom wall, a continuous upright side wall forming an interior cavity, and a drain positioned near the bottom wall to allow drainage of water. The receptacle cavity is filled with a quantity of beverages and ice to chill the beverages.

While these containers work well soon after filling, they become unsightly after the ice starts to melt, resulting in immersion of the beverages. Moreover, removal becomes inconvenient, since the purchaser must reach into the water to remove the beverages. This practice may also pose a health risk. In addition, the distance that a customer can reach into a container is limited by the presence of the water and the distance to the bottom of the container, thus limiting the quantity of beverages that can be displayed.

Attempts have been made to address certain of these disadvantages. For example, U.S. Pat. No. 4,724,682 to Flum et al describes a chilled beverage container which includes a drainage tank beneath a beverage holder. As the ice in the beverage holder melts, the water drains into the tank, separating it from the ice and beverages.

U.S. Pat. No. 5,048,305 to Taub, describes a similar approach in which a beverage container has a lower sump zone comprised of spacers which support the beverages and ice above the water which collects between the spacers.

Other chilled beverage containers are described in U.S. Pat. No. 4,995,238 to King; U.S. Pat. No. 5,169,020 to Spamer; U.S. Pat. Nos. 4,982,840 and 5,048,171 to Bidwell; and U.S. Pat. No. 4,946,032 to Stoddard.

Basically, the containers described in all of the above patents, as well as most containers commercially available, comprise an outer container having a height of about 30 to 40 inches which rests on the floor, and an inner container supported within the outer container. The bottom of this inner container is substantially above the bottom of the outer container, so that beverages near the bottom can be reached by customers. This configuration, while improving accessibility of the beverages, limits the number of beverages that can be loaded, thus requiring frequent reloading of the container.

The present application describes an improved chilled beverage container which allows the user to maintain beverages and unmelted ice separate from water formed by melting ice, thus improving the appearance of and ease of access to, the beverages. It allows loading with a large number of beverages, thus reducing the number of times it must be reloaded. Since the customers do not have to reach into the water to retrieve the beverages, the health risk is also reduced.

Also, one of the main functions of a chilled beverage container is to assist in the marketing and sales of the contained beverages. It would be advantageous if the container could be equipped with a convenient way to assist in attracting the customers' attention, such as by signage.

SUMMARY OF THE INVENTION

The present invention fulfills this need in the art by providing a beverage container adapted to hold ice and beverages separate from water formed from melted ice including a receptacle having an interior cavity for holding ice and beverages; a float having a density less than water adapted to support the ice and beverages and move upwardly within the cavity as the ice melts; a cover mounted on the receptacle by a hinge, and a tubesign base removably attached to the hinge. The hinge may have slots and the tubesign base have tabs, so as to enable attachment of the tubesign base to the hinge by insertion of the tabs in the slots.

In a preferred embodiment the receptacle has an upper rim, the hinge includes a plate secured to the upper rim with slots between the plate and the upper rim, and the tubesign base has tabs, so as to enable attachment of the tubesign base to the hinge by insertion of the tabs in the slots. Preferably, the tabs have distal ends and lobes on the distal ends, so the lobes lock the tabs into the slots when inserted therein. Desirably, the lobes are wedge-shaped. Typically, at least one of the tabs has a length from a base to its lobe and the slot includes a recess and an opening at a depth in the recess corresponding to the length.

In a preferred embodiment there are three tabs and three slots, and each of the tabs has a length from a base to its lobe and each of the slots has a recess and an opening at a depth in the recess corresponding to the length.

In one embodiment the tubesign base includes an outwardly extending portion having an outer rim and a inner rim, whereby a tubesign of a circumference corresponding to the outer rim may be engaged by the outer rim or a tubesign of a circumference corresponding to the inner rim may be engaged by the inner rim. Preferably, the outwardly extending portion and the outer and inner rims are molded out of a single piece of plastic. Desirably, the outwardly extending portion includes a depending, rigid, peripheral skirt.

In a preferred embodiment the receptacle has an upper rim,the hinge includes first and second hinged plates, the first plate is secured to the upper rim, the second plate is secured to the cover, and the first and second plates have opposed wedges positioned thereon so as contact one another to limit the pivoting range of the cover. More generally, the receptacle may have an upper rim, and the upper rim and cover may have opposed wedges positioned thereon so as contact one another to limit the pivoting range of the cover.

In a preferred embodiment at least one of the tabs has a hole to permit a fastener to be used to fasten the tab to the hinge.

The invention also provides a tubesign base for a attachment to a cold barrel including a body having three tabs having distal ends, lobes on the distal ends and lengths from bases of the tabs to their lobes corresponding to the depth, so as to enable removable attachment of the tubesign base by insertion of the tabs into slots on a cold barrel, with the lobes locking the tabs into the slots when inserted therein and an outwardly extending portion having an outer rim and a inner rim, whereby a tubesign of a circumference corresponding to the outer rim may be engaged by the outer rim or a tubesign of a circumference corresponding to the inner rim may be engaged by the inner rim, the outwardly extending portion and the outer and inner rims being molded out of a single piece of plastic, and the outwardly extending portion including a depending, rigid, peripheral skirt.

The invention also provides a beverage container adapted to hold ice and beverages separate from water formed from melted ice including a receptacle having an interior cavity for holding ice and beverages; a float having a density less than water adapted to support the ice and beverages and move upwardly within the cavity as the ice melts; a drain at the bottom of the cavity, and a drain cover over the drain to prevent entry of debris. In a preferred embodiment the cavity has a bottom wall with a recess therein, the drain is located in the recess, and a drain hose extends from the recess exteriorly of the receptacle. Preferably, the recess has boundary portions and the drain cover removably fits to the boundary portions.

The invention also provides a beverage container adapted to hold ice and beverages separate from water formed from melted ice including a receptacle having an interior cavity extending substantially the entire height of the receptacle; and a float vertically movable within the interior cavity having a density less than water and adapted to support ice and beverages and move upwardly within the cavity as supported ice melts and meltwater drains to a location in the interior cavity below the float.

BRIEF DESCRIPTION OF THE DRAWINGS

FIG. 7 is a cross-sectional view of the tubesign base showing its attachment to the container, taken along lines 7—7 of FIG. 6.

FIG. 8 is an exploded view of an alternate, preferred embodiment of the drain.

FIG. 9 is a perspective view of a preferred embodiment of the float.

DETAILED DESCRIPTION OF THE PREFERRED EMBODIMENT

Figure 1:
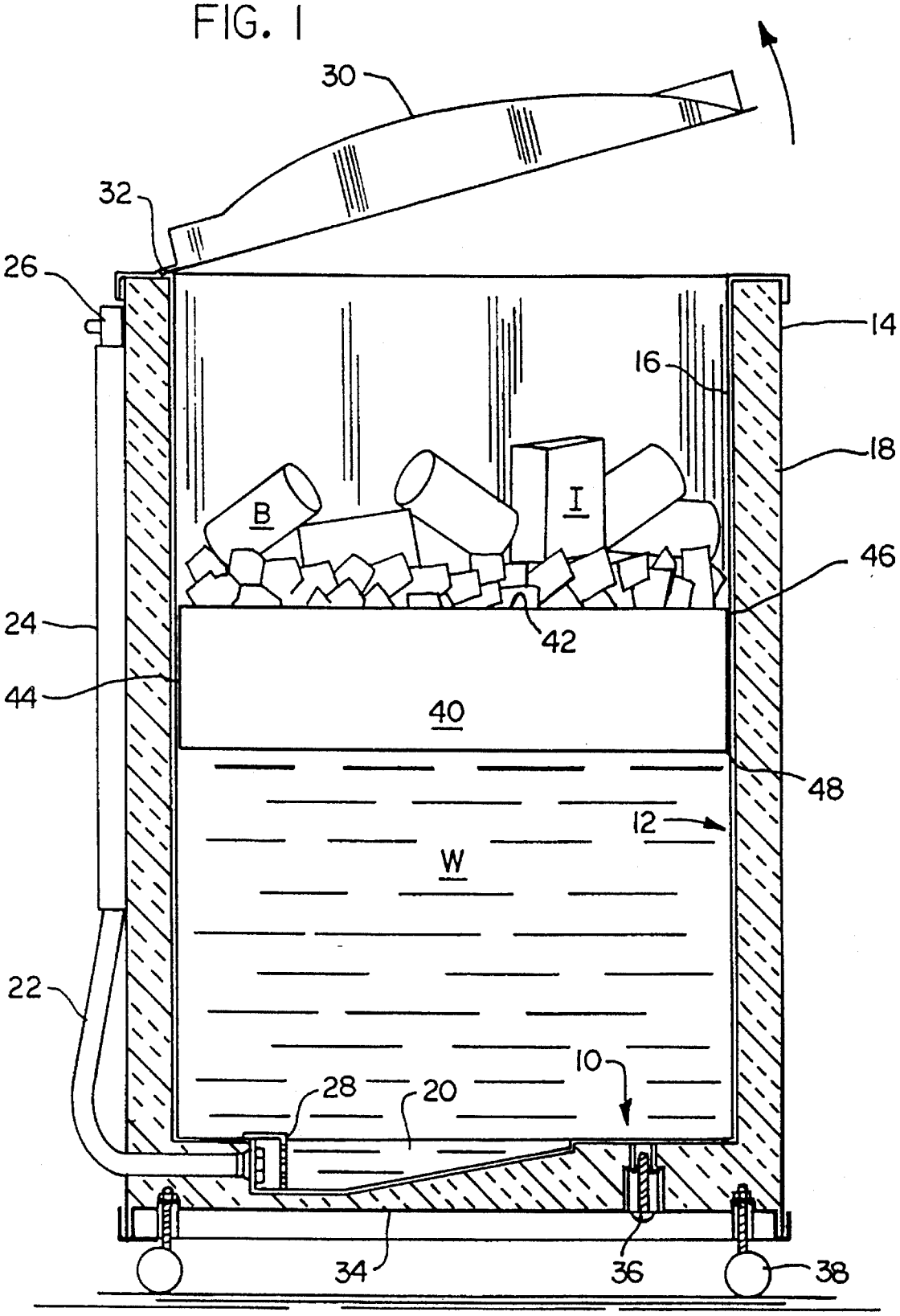
FIG. 1 is a cross-sectional plan view of a container of the present invention with a substantially vertical side wall.
Figure 2:
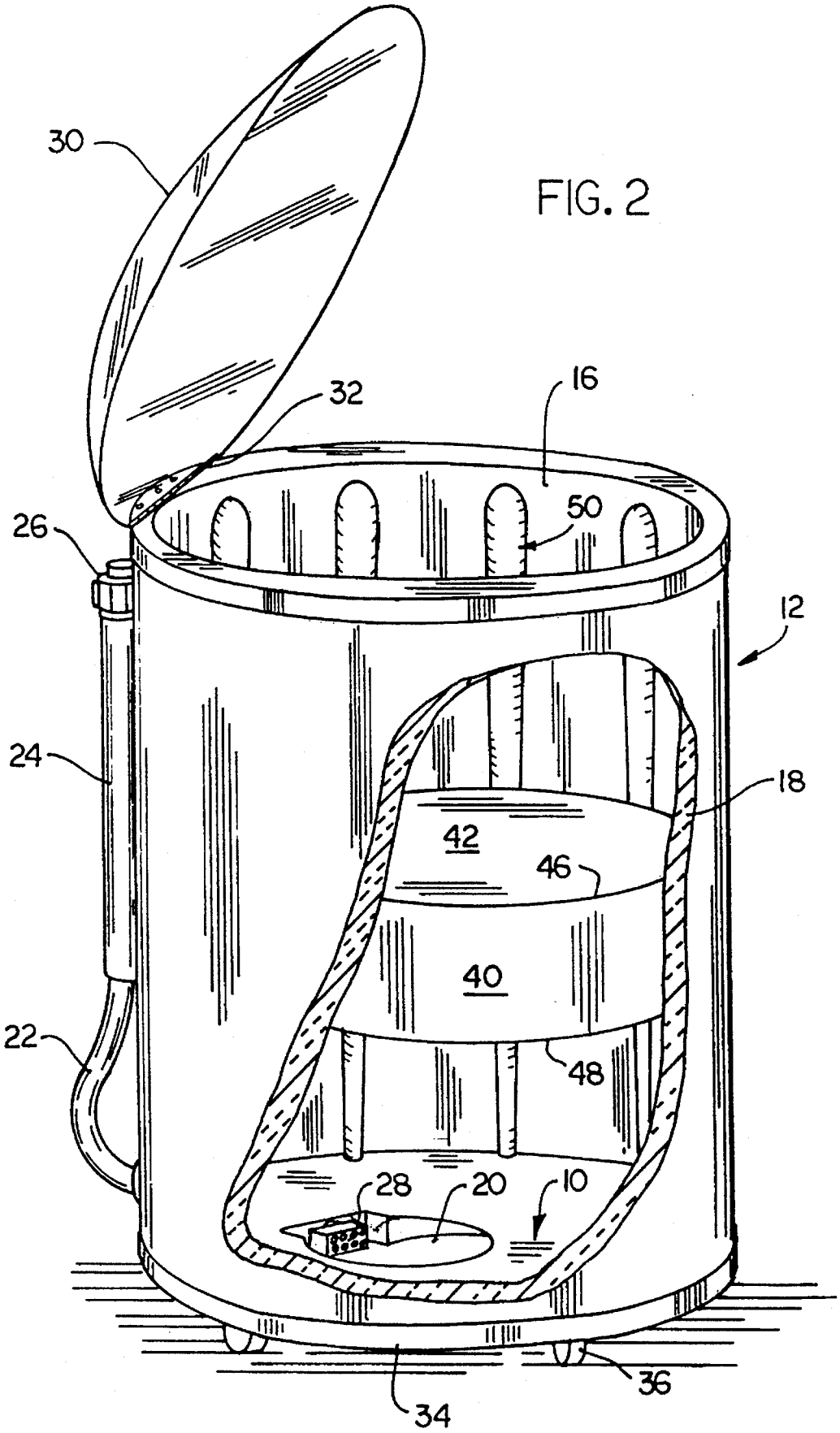
FIG. 2 is a cut away, perspective view of a container of the present invention with a diverging side wall and vertical ribs.
Figure 3:
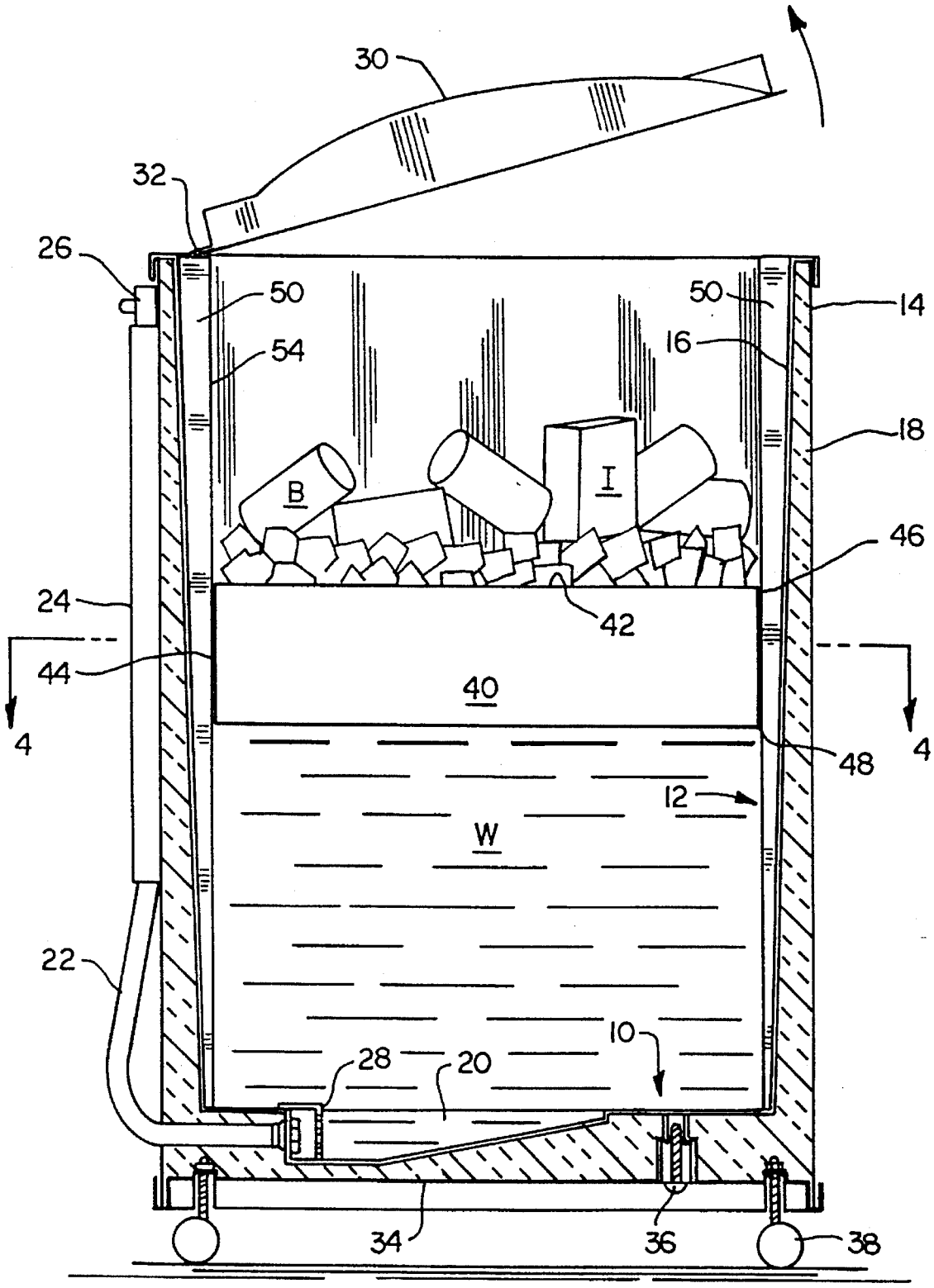
FIG. 3 is a cross-sectional plan view of the container of FIG. 2.
Figure 4:
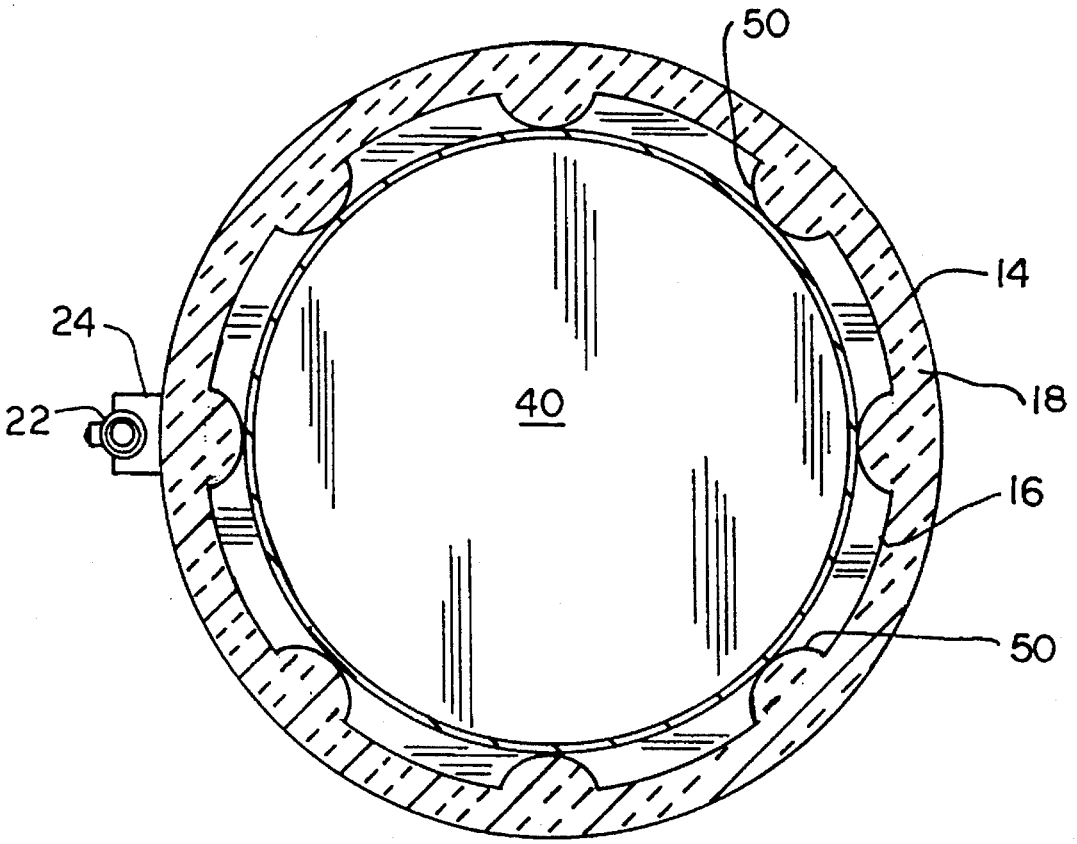
FIG. 4 is a top view of FIG. 2 along line 4—4.

The preferred embodiment of the chilled beverage container is comprised of a receptacle having a bottom wall, generally 10, a side wall, generally 12, integral at its lower edge with bottom wall 10. Walls 10 and 12 may comprise an outer segment 14 and a spaced inner segment 16, which are separated by a cavity 18, filled with, e.g., styrofoam.

Since the styrofoam provides strength to walls 10 and 12, it is not essential that segments 14 and 16 are of sufficient strength to support the weight of the receptacle contents. Wall segment 16 may, for example, be formed of a thin sheet of graphic material used primarily to improve the outer appearance of the container and provide an advertising surface.

Bottom wall 10 has a recess 20 therein. A drain hose 22 extends from recess 20 to the exterior of the receptacle. Drain hose 22 is detachably held against wall 12 in holder 24. Hose 22 has a valve 26 at its terminal end to control water flow. A drain cover 28 in recess 20 prevents entry of debris.

A preferred drain is seen in FIG. 8. Within recess 120, molded boundaries 125 provide nesting engagement for the removable cover 128. As can be seen, the cover 128 has an L-shaped cross section, with one face of the L having apertures 130 and the other solid with a cut-out slot 132. The cover 128 may be snapped into place in either of two orientations—with the face with apertures 130 vertical or horizontal. Once the drinks of a load have been sold out, the float 40 may be removed and the drain cover 128 may be accessed. Since it is removable, it may be removed from the recess 120 for cleaning and replaced. The arrangement of the wide array of holes in the cover 128 minimizes the possibility that the drain may become clogged. Inside the boundaries 125, the floor is recessed as a sump 134 in which fine matter that may pass through apertures 130 may collect. The sump has a lower portion below the bottom of drain opening 122.

Figure 6:
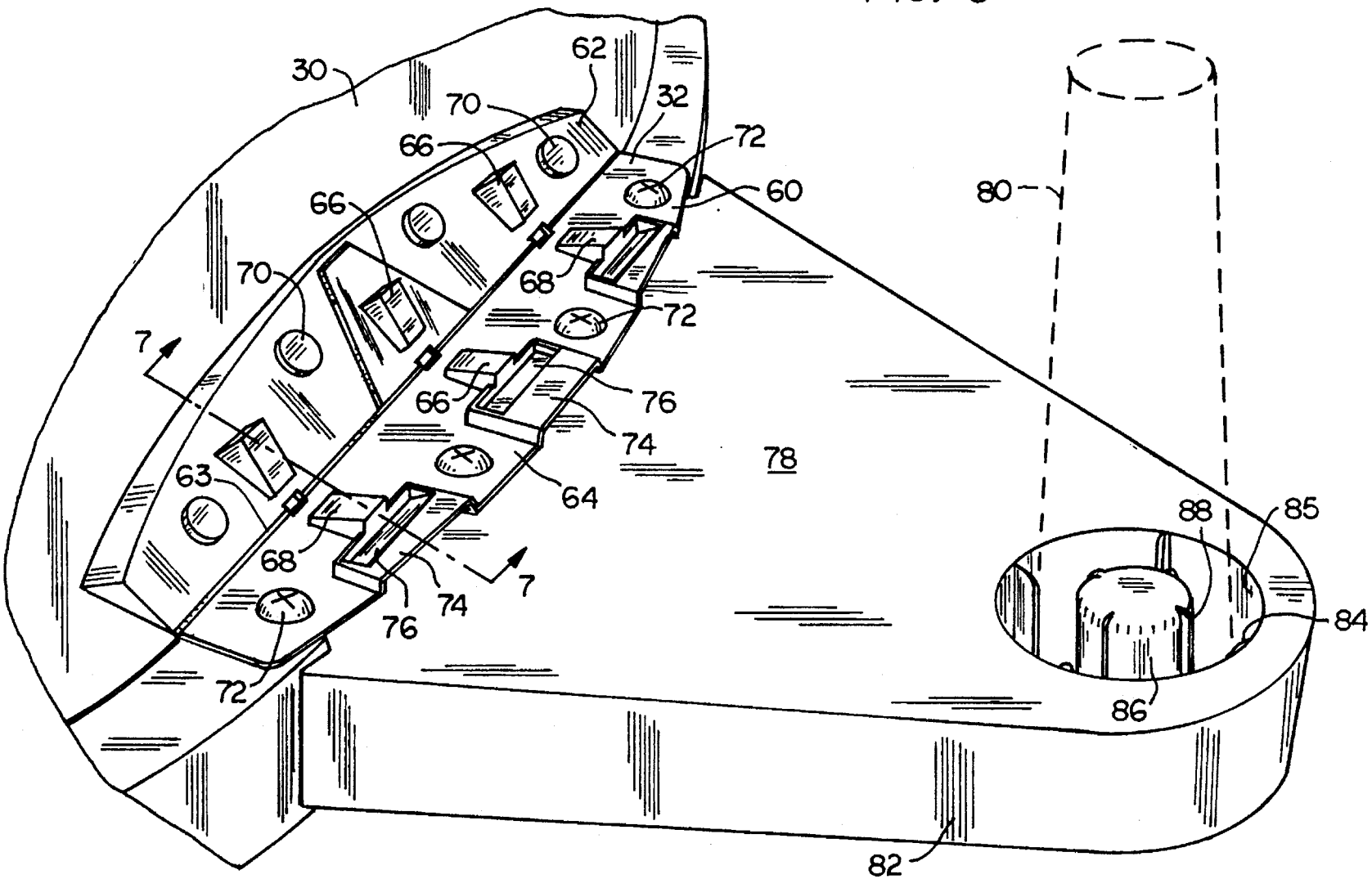
FIG. 6 is a perspective view of a tubesign base attached to the container in accordance with the invention.

A transparent, convex top 30 is attached to the upper edge of wall 12 by hinge 32. A preferred hinge structure 60 is seen in FIG. 6. As seen in FIG. 6, the preferred hinge structure 60 is made up of plate elements 62 and 64 joined along a common flexible line 63. Plate 62 is joined to cover 30 by plastic nut and bolt assemblies 70. Any other suitable joining arrangement could be substituted. The plate 62 has formed on it three wedge-shaped elements 66 corresponding in location to matching wedge-shaped elements 68 formed on the plate 64. As the hinge opens along line 63, the wedge-shaped elements 66, 68 abut, to limit the amount that the hinge can open. Typically, the hinge should open to just past vertical so that it is stable, but does not interfere with the tubesign 80 shown in phantom in FIG. 6.

The plate 64 of the hinge is mounted to the upper rim of the side wall 12 by screws 72. Plate 64 has three outwardly facing slots or channels 74 terminating in opening 76. These channels receive tabs on the tubesign base 78.

The tubesign base 78 has forwardly projecting tabs, not seen in FIG. 6, as obscured by the hinge plate 64. The outermost tabs have lobes, preferably wedge-shaped, to permit insertion in the slot 74 but engage the openings 76 to prevent withdrawal, much like a barb. However, the tubesign is removable by insertion of the blade of a screwdriver, or the like, into the slot 74 to lift it up and disengage the barb.

The tubesign base 78 has a depending rigid peripheral skirt 72, which provides rigidity and assures that the tubesign base 78 cantilevers outwardly from the side wall 12 when installed.

Depending within the tubesign base 78 is an annular cavity 85. Inside the annular cavity is a nub 86 having an internal diameter approximating the typical internal diameter of a common size of tubesign—namely 1 ¼ inches. The nub has outwardly protruding ribs 88 to provide resilient engagement to the inside of such a tubesign.

The inside face of the annular cavity 85 is dimensioned to approximate the outside diameter of another size of common tubesign—namely 1¾ inches. It is provided with inwardly facing ribs 84 to provide resilient engagement to the outer walls of such tubesigns. Thus, the retailer can install the tubesign base 78 onto the cold barrel by simply engaging the tabs in their respective slots 74 and press-fitting the desired tubesign on the annular cavity 85 to display whatever advertising on the tubesign is desired. If it is later decided that such advertising is not desired, the tubesign holder can be removed from the cold barrel as mentioned above by insertion of a screwdriver blade in the slots 74 to pry them open to remove the barb-like lobes of the tabs. The tubesign base can be conveniently made as a single molded item including the protruding tabs, their barb-like lobes and the annular tubesign hole, along with the peripheral depending skirt. Alternatively, an attachment other than a tubesign holder equipped with suitable tabs could be affixed to the hinge plate 64.

The central tab can be provided with an aperture to permit installation on the sidewall 12 without the hinge, or spaced from the hinge, by driving a screw through the hole in central tab and into the top of sidewall 12.

A horizontal support base 34 is secured to the exterior of bottom wall 10 by bolts 36, adhesive, or other conventional means. Support base 34 includes a plurality of casters 38, to facilitate movement of the container when filled.

Beverages (B) and ice (I) are supported in the receptacle cavity on a float 40, which rests on water (W) produced by melting ice. Float 40 is lighter than water and is formed of blow-molded polyethylene. Since one cubic foot of air supports sixty-two pounds, one skilled in the art will be able to readily calculate the volume of air which needs to be enclosed by the float to support a desired quantity of ice and beverages.

Float 40 is comprised of a float top wall 42, and a float side wall 44 which has an upper edge 46 integral with wall 42, and a lower edge 48 spaced from upper edge 46. A preferred float design is seen in FIG. 9. Float 40' has convex upper and lower walls 42' to assure drainage of melt water from whichever is the upper wall at any given installation. In addition, the walls 42' have radial ribs 43' molded thereto to assure that the melt water can pass under the float 42'.

Figure 5:
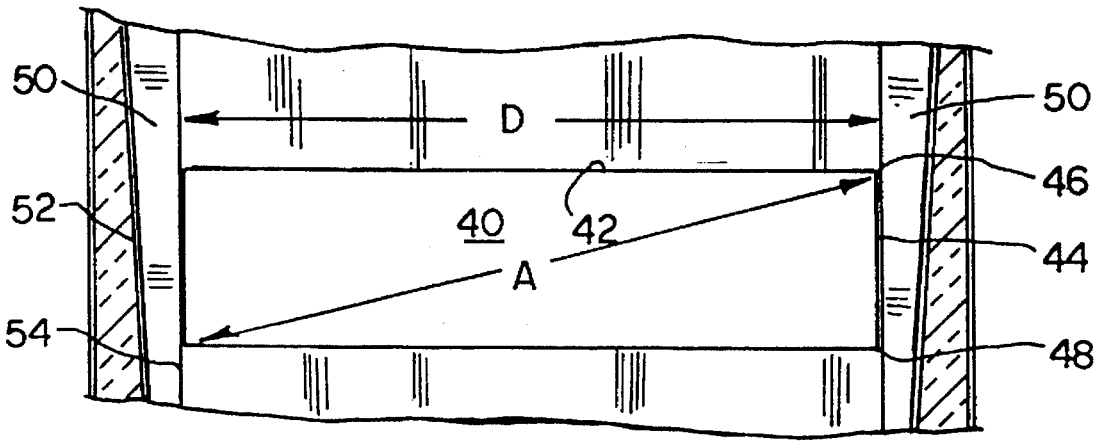
FIG. 5 is a cross-sectional plan view of the float and opposed ribs, illustrating the dimensions required to prevent tipping of the float in the cavity.

It is important that the float not tip during use. As illustrated in FIG. 5, tipping can be prevented if the cross-sectional diameter "D" of the interior cavity is less than the distance "E" from a point on one edge of the side wall to a point on the opposing edge of the side wall at a diametrically opposed point on the float.

When the receptacle has an interior cavity with a vertical side wall, as shown in FIG. 1, side wall 44 is adjacent inner wall segment 16, with the separation between wall 44 and segment 16 being only sufficient to allow water to flow between them and allow upward movement of float 40. Generally, this separation will be from about one-sixteenth to about one-eighth inch.

When inner wall segment 16 is formed of molded plastic, however, the segment will diverge outwardly toward the top, due to the mold configuration required for mold release. When using an inner wall segment of this type, it is desirable to incorporate a plurality of upright ribs 50 as shown in FIGS. 2–5. Ribs 48 have an outer face 52 positioned against inner wall segment 16 and a vertical inner face 54 toward float 40.

Outer face 52 is curved to fit against wall 16, while inner face 54 is semi-circular. In this embodiment, float 40 extends across the interior cavity between opposed ribs, with side wall 44 being adjacent inner faces 54. Spacing between wall 44 and faces 54 is the same as described above for spacing between wall 44 and segment 16 when segment 16 is vertical.

In operation, interior cavity 18 is filled with ice and beverages which rest on float 40 at the bottom of cavity 18. As ice begins the melt, the resulting water flows between float 40 and wall 12. Float 40 begins to rise as it floats on the water, holding the beverages and remaining ice above the surface of the water and in a position where they may be readily reached by the purchaser. Periodically, water is drained from the bottom of the cavity through hose 22, and ice and beverages added to the container.

As noted, the beverage container holds ice and beverages separate from water formed from melted ice. The container includes a receptacle having an interior cavity extending substantially the entire height of the receptacle and a float vertically movable within the interior cavity having a density less than water and adapted to support ice and beverages and move upwardly within the cavity as supported ice melts and meltwater drains to a location in the interior cavity below the float. This design permits the invention to provide these advantages over conventional cold barrel designs:

a. The containers of beverages are elevated so they are convenient to the customer, increasing the likelihood of making a sale. Since the float raises the beverages as meltwater moves under it, the beverages stay near the top of the barrel, eliminating the need to reach down deeply into the barrel.

b. Since the float eliminates the need for a customer to bend over to get to the bottom of the barrel, the barrel may be made to a full floor depth, enabling the retailer to load a larger inventory of containers in the barrel. This enhances the use of expensive retail floor space and the variety of beverages available to be sold.

c. Since the float raises the inventory to be in easy reach, there is less need to add more beverages periodically. This permits the barrel to be loaded and not replenished until the stock is nearly exhausted, helping the retailer rotate stock, which is important to maintaining freshness.

d. Since the storage space for the meltwater may grow as the ice melts (i.e. the space needed above the float decreases as the ice melts, so that the space below the float can grow to accommodate the meltwater), less frequent servicing is needed than with cold barrels having a fixed meltwater storage tank. Servicing is needed only once every four or five days, compared to three times a day with conventional designs.

e. Since the barrel may be made to a full depth, the center of gravity of the filled cold barrel is lower than with an elevated tub like the one shown in U.S. Pat. No. 5,048,305 to Taub. The lower center of gravity decreases the chance of tipping the filled barrel when it is moved. Tipping is a problem with prior art barrels like Taub's. Some cold barrels exhibit warnings on their lids not to move once loaded.

f. With designs having a lower fixed tank, ice can be added and allowed to melt, ultimately to result in the buildup of meltwater to cover the beverages. The excess addition of meltwater to the present invention, on the other hand, raises the float and the supported beverages. Since the containers of beverages are floated above the meltwater, there is no possibility of the top containers ever being immersed in the meltwater, regardless of the proportions of ice and beverages placed in the cold barrel and regardless of the respective rates of removal of beverages and melting of ice.

g. Experience has shown that mold will eventually grow in cold barrels made using the technology of U.S. Pat.

No. 5,048,305 to Taub. Mold has not been found to grow in the cold barrel of the present invention, apparently due to the complete servicing the cold barrel is given once every four or five days. Employees of stores having the Taub device must drain water several times a day and typically add ice and/or more beverages, so that it is rarely convenient to clean, and, by design, very difficult to clean properly.

Certain modifications and improvements will occur to those skilled in the art upon a reading of the foregoing description. By way of example, different interior cavities from that described may be used. Also, the float may be of a shape different from the cross-sectional shape of the interior cavity, so long as tipping is avoided, and the top wall can include openings to facilitate drainage. It should be understood that all such modifications and improvements have been deleted herein for the sake of conciseness and readability, but are properly within the scope of the following claims.

What is claimed is:

1. A beverage container adapted to hold ice and beverages separate from water formed from melted ice comprising (a) a receptacle having an interior cavity for holding ice and beverages;

(b) a float having a density less than water adapted to support said ice and beverages and move upwardly within said cavity as said ice melts;

(c) a cover mounted on said receptacle by a hinge, and (d) a tubesign base removably attached to said hinge.

2. A beverage container as claimed in claim 1 wherein said receptacle has an upper rim, said hinge includes a plate secured to said upper rim with slots between said plate and said upper rim, and said tubesign base has tabs, so as to enable attachment of said tubesign base to said hinge by insertion of said tabs in said slots.

3. A beverage container as claimed in claim 1 wherein said hinge has slots and said tubesign base has tabs, so as to enable attachment of said tubesign base to said hinge by insertion of said tabs in said slots.

4. A beverage container as claimed in claim 3 wherein said tabs have distal ends and lobes on said distal ends, so said lobes lock said tabs into said slots when inserted therein.

5. A beverage container as claimed in claim 4 wherein said lobes are wedge-shaped.

6. A beverage container as claimed in claim 5 wherein at least one of said tabs has length from a base to its lobe and said slot includes a recess and an opening at a depth in said recess corresponding to said length.

7. A beverage container as claimed in claim 6 wherein there are three tabs and three slots and each of the tabs has a length from a base to its lobe and each of said slots has a recess and an opening at a depth in said recess corresponding to said length.

8. A beverage container as claimed in claim 2 wherein said tubesign base includes an outwardly extending portion having an outer rim and a inner rim, whereby a tubesign of a circumference corresponding to the outer rim may be engaged by said outer rim or a tubesign of a circumference corresponding to the inner rim may be engaged by said inner rim.

9. A beverage container as claimed in claim 8 wherein said outwardly extending portion and said outer and inner rims are molded out of a single piece of plastic.

10. A beverage container as claimed in claim 8 wherein said outwardly extending portion includes a depending, rigid, peripheral skirt.

11. A beverage container as claimed in claim 1 wherein said receptacle has an upper rim, said hinge includes first and second hinged plates, said first plate is secured to said upper rim, said second plate is secured to said cover, and said first and second plates have opposed wedges positioned thereon so as contact one another to limit the pivoting range of said cover.

12. A beverage container as claimed in claim 1 wherein said receptacle has an upper rim, and said upper rim and cover have opposed wedges positioned thereon so as contact one another to limit the pivoting range of said cover.

13. A beverage container as claimed in claim 1 wherein said hinge has slots and said tubesign base has tabs, so as to enable attachment of said tubesign base to said hinge by insertion of said tabs in said slots and at least one of said tabs has a hole to permit a fastener to be used to fasten said tab to said hinge.

14. A beverage container adapted to hold ice and beverages separate from water formed from melted ice comprising (a) a receptacle having an interior cavity for holding ice and beverages;

(b) a float having a density less than water adapted to support said ice and beverages and move upwardly within said cavity as said ice melts;

(c) a cover mounted on said receptacle by a hinge having three slots including a recess and an opening at a depth in said recess, and (d) a tubesign base having three tabs having distal ends, lobes on said distal ends and lengths from bases of the tabs to their lobes corresponding to said depth, so as to enable removable attachment of said tubesign base to said hinge by insertion of said tabs in said slots, with said lobes locking said tabs into said slots when inserted therein.

15. A beverage container adapted to hold ice and beverages separate from water formed from melted ice comprising (a) a receptacle having an interior cavity for holding ice and beverages;

(b) a float having a density less than water adapted to support said ice and beverages and move upwardly within said cavity as said ice melts;

(c) a cover mounted on said receptacle by a hinge having slots including a recess and an opening at a depth in said recess, and (d) a tubesign base having (i) three tabs having distal ends, lobes on said distal ends and lengths from bases of the tabs to their lobes corresponding to said depth, so as to enable removable attachment of said tubesign base to said hinge by insertion of said tabs in said slots, with said lobes locking said tabs into said slots when inserted therein, (ii) an outwardly extending portion having an outer rim and a inner rim, whereby a cylindrical tubesign of a circumference corresponding to the outer rim may be engaged by said outer rim or a cylindrical tubesign of a circumference corresponding to the outer rim may be engaged by said outer rim; and (iii) wherein said tabs, said outwardly extending portion and said outer and inner rims are molded out of a single piece of plastic.

16. A beverage container adapted to hold ice and beverages separate from water formed from melted ice comprising (a) a receptacle having an interior cavity for holding ice and beverages;

(b) a float having a density less than water adapted to support said ice and beverages and move upwardly within said cavity as said ice melts;

(c) a drain at the bottom of said cavity, and (d) a drain cover over said drain to prevent entry of debris.

17. A beverage container as claimed in claim 16 wherein said cavity has a bottom wall with a recess therein, said drain is located in said recess, and a drain hose extends from said recess exteriorly of the receptacle.

18. A beverage container as claimed in claim 17 wherein said recess has boundary portions and said drain cover removably fits to said boundary portions.

19. A beverage container adapted to hold ice and beverages separate from water formed from melted ice comprising (a) a receptacle having an interior cavity extending substantially the entire height of said receptacle; and (b) a float vertically movable within said interior cavity having a density less than water and adapted to support ice and beverages and move upwardly within said cavity as supported ice melts and meltwater drains to a location in said interior cavity below said float.

20. A beverage container as claimed in claim 19 wherein said float has a convex upper wall.

21. A beverage container as claimed by claim 20 wherein said float has protrusions from a lower side.

22. A tubesign base for a attachment to a cold barrel comprising a body having three tabs having distal ends, lobes on said distal ends and lengths from bases of the tabs to their lobes corresponding to said depth, so as to enable removable attachment of said tubesign base by insertion of said tabs into slots on a cold barrel, with said lobes locking said tabs into the slots when inserted therein and an outwardly extending portion having an outer rim and a inner rim, whereby a tubesign of a circumference corresponding to the outer rim may be engaged by said outer rim or a tubesign of a circumference corresponding to the inner rim may be engaged by said inner rim, said outwardly extending portion and said outer and inner rims being molded out of a single piece of plastic, and said outwardly extending portion including a depending, rigid, peripheral skirt.

* * * * *